US011776503B2

(12) United States Patent
Ratnasingam et al.

(10) Patent No.: US 11,776,503 B2
(45) Date of Patent: Oct. 3, 2023

(54) GENERATING DISPLAY DATA BASED ON MODIFIED AMBIENT LIGHT LUMINANCE VALUES

(71) Applicant: Apple Inc., Cupertino, CA (US)

(72) Inventors: Sivalogeswaran Ratnasingam, San Jose, CA (US); Anselm Grundhoefer, Campbell, CA (US); Ralf Habel, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/223,512

(22) Filed: Apr. 6, 2021

(65) Prior Publication Data

US 2021/0375232 A1 Dec. 2, 2021

Related U.S. Application Data

(60) Provisional application No. 63/031,407, filed on May 28, 2020.

(51) Int. Cl.
*G09G 5/02* (2006.01)

(52) U.S. Cl.
CPC ..... *G09G 5/02* (2013.01); *G09G 2320/0233* (2013.01); *G09G 2320/0666* (2013.01); *G09G 2360/144* (2013.01)

(58) Field of Classification Search
CPC ..... G09G 5/02; G09G 2320/0233; G09G 2320/0666; G09G 2360/144; G09G 5/14; G09G 5/10; G09G 2320/0626; G09G 2320/066
See application file for complete search history.

(56) References Cited

U.S. PATENT DOCUMENTS

2013/0113973 A1* 5/2013 Miao ..... G02B 27/017 348/E5.022
2020/0160812 A1* 5/2020 Tovchigrechko ..... G09G 3/003
2021/0063732 A1* 3/2021 Kajita ..... G02B 27/0093
2021/0248955 A1* 8/2021 Walters ..... G09G 3/32

* cited by examiner

*Primary Examiner* — Sahlu Okebato

(74) *Attorney, Agent, or Firm* — Fernando & Partners LLP

(57) ABSTRACT

A method includes sensing a plurality of luminance values associated with ambient light from a physical environment. The plurality of luminance values quantifies the ambient light arriving at a see-through display. The method includes identifying respective portions of the plurality of luminance values, across the see-through display, based on corresponding portions of rendered image data. The method includes modifying one or more of the respective portions of the plurality of luminance values based on a function of predetermined display characteristics associated with the rendered image data, in order to generate one or more modified portions of the plurality of luminance values. The method includes modifying the corresponding portions of the rendered image data in order to generate display data, based on the one or more modified portions of the plurality of luminance values. The method includes displaying, on the see-through display, the display data.

20 Claims, 16 Drawing Sheets

GENERATING DISPLAY DATA BASED ON MODIFIED AMBIENT LIGHT LUMINANCE VALUES

CROSS-REFERENCE TO RELATED APPLICATION

This application claims priority to U.S. Provisional Patent App. No. 63/031,407, filed on May 28, 2020, which is hereby incorporated by reference in its entirety.

TECHNICAL FIELD

The present disclosure relates to generating display data, and, in particular, generating display data based on modified ambient light luminance values.

BACKGROUND

In augmented reality (AR), computer-generated content is composited with a user's physical environment in order to comingle computer generated visual content with real-world objects. A user may experience AR via an electronic device that includes a see-through display, which, in turn, allows the pass-through of light from the user's physical environment to the user's eyes.

In some circumstances, however, light from the physical environment has a luminance and/or color composition that interferes with computer-generated content in a manner that degrades the AR experience. For example, light from the physical environment results in displayed computer-generated content having a limited contrast level or incorrect color profile. However, previously available see-through display systems do not effectively account for light from the physical environment, resulting in undesirable displayed artifacts.

SUMMARY

In accordance with some implementations, a method is performed at an electronic device with one or more processors, a non-transitory memory, and a see-through display. The method includes sensing a plurality of luminance values associated with ambient light from a physical environment. The plurality of luminance values quantifies the ambient light arriving at a see-through display. The method includes identifying respective portions of the plurality of luminance values, across the see-through display, based on corresponding portions of rendered image data. The method includes modifying one or more of the respective portions of the plurality of luminance values based on a function of predetermined display characteristics associated with the rendered image data, in order to generate one or more modified portions of the plurality of luminance values. The method includes modifying the corresponding portions of the rendered image data in order to generate display data, based on the one or more modified portions of the plurality of luminance values. The method includes displaying, on the see-through display, the display data.

In accordance with some implementations, an electronic device includes one or more processors, a non-transitory memory, and a see-through display. The one or more programs are stored in the non-transitory memory and configured to be executed by the one or more processors and the one or more programs include instructions for performing or causing performance of the operations of any of the methods described herein. In accordance with some implementations, a non-transitory computer readable storage medium has stored therein instructions which when executed by one or more processors of an electronic device, cause the device to perform or cause performance of the operations of any of the methods described herein. In accordance with some implementations, an electronic device includes means for performing or causing performance of the operations of any of the methods described herein. In accordance with some implementations, an information processing apparatus, for use in an electronic device, includes means for performing or causing performance of the operations of any of the methods described herein.

BRIEF DESCRIPTION OF THE DRAWINGS

For a better understanding of the various described implementations, reference should be made to the Description, below, in conjunction with the following drawings in which like reference numerals refer to corresponding parts throughout the figures.

SUMMARY

Figure 1:
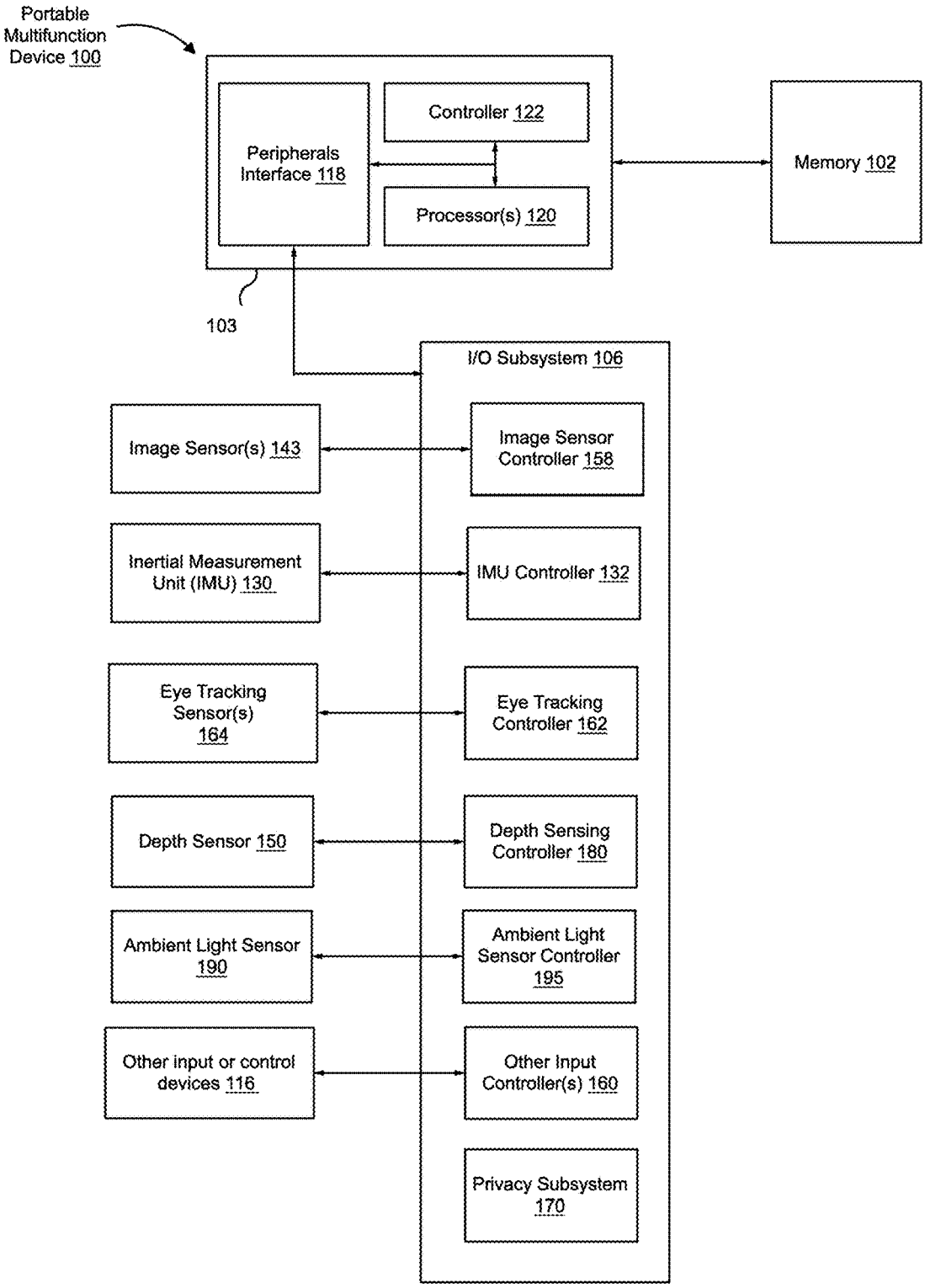
FIG. 1 is a block diagram of an example of a portable multifunction device in accordance with some implementations.

In augmented reality (AR), computer-generated content is composited with a user's physical environment in order to comingle computer generated visual content with real-world objects. A user may experience AR via an electronic device that includes a see-through display, which, in turn, allows the pass-through of light from the user's physical environment to the user's eyes. The see-through display operates as an additive display by projecting computer-generated content to be reflected off of the see-through display to the user's eyes; or, directly at the user's retinas, where pass-through light from the physical environment and the projected light of the computer-generated content concurrently reach the retinas. In some circumstances, however, light from the physical environment has a luminance and/or color composition that interferes with computer-generated content in a manner that degrades the AR experience. For example, light from the physical environment limits a level of contrast between the physical environment and displayed computer-generated content. As another example, color composition of the physical environment, such as the presence of predominantly one color, may interfere with the color composition of displayed computer-generated content by providing dominant hues that are difficult to mask using additive display methods and hardware. However, display systems do not effectively account for light from the physical environment, leading to various problems. For example, a conventional pixel-based gamut mapping creates unwanted displayed artifacts, such as color shift, limited dynamic range in relatively bright regions, false color artifacts, etc.

By contrast, various implementations disclosed herein provide methods, electronic devices, and systems for modifying a selected portion of luminance values associated with ambient light from a physical environment, based on predetermined display characteristics associated with rendered image data. To that end, an electronic device, with a see-through display, senses luminance values associated with the ambient light from the physical environment. The electronic device identifies respective portions of the luminance values based on corresponding portions of rendered image data. For example, the electronic device identifies a first luminance value corresponding to an object-of-interest represented by the rendered image data, such as a person's face. The electronic device modifies (e.g., preprocesses) the respective portions of the luminance values based on predetermined display characteristics associated with the rendered image data. For example, the electronic device modifies a luminance value based on a preferred chromaticity characteristic associated with a face represented by the rendered image data, in order to maintain a relatively uniform skin tone for the face. The electronic device modifies the corresponding portions of the rendered image data in order to generate display data, based on the one or more modified portions of the plurality of luminance values. The see-through display displays the display data. Accordingly, the presence of artifacts (e.g., color shift errors) is reduced as compared with other systems. Thus, the user-experience (e.g., AR experience) is enhanced.

DESCRIPTION

Reference will now be made in detail to implementations, examples of which are illustrated in the accompanying drawings. In the following detailed description, numerous specific details are set forth in order to provide a thorough understanding of the various described implementations. However, it will be apparent to one of ordinary skill in the art that the various described implementations may be practiced without these specific details. In other instances, well-known methods, procedures, components, circuits, and networks have not been described in detail so as not to unnecessarily obscure aspects of the implementations.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described implementations. The first contact and the second contact are both contacts, but they are not the same contact, unless the context clearly indicates otherwise.

The terminology used in the description of the various described implementations herein is for the purpose of describing particular implementations only and is not intended to be limiting. As used in the description of the various described implementations and the appended claims, the singular forms "a", "an", and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes", "including", "comprises", and/or "comprising", when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting", depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]", depending on the context.

A physical environment refers to a physical world that people can sense and/or interact with without aid of electronic devices. The physical environment may include physical features such as a physical surface or a physical object. For example, the physical environment corresponds to a physical park that includes physical trees, physical buildings, and physical people. People can directly sense and/or interact with the physical environment such as through sight, touch, hearing, taste, and smell. In contrast, an extended reality (XR) environment refers to a wholly or partially simulated environment that people sense and/or interact with via an electronic device. For example, the XR environment may include augmented reality (AR) content, mixed reality (MR) content, virtual reality (VR) content, and/or the like. With an XR system, a subset of a person's physical motions, or representations thereof, are tracked, and, in response, one or more characteristics of one or more virtual objects simulated in the XR environment are adjusted in a manner that comports with at least one law of physics. As one example, the XR system may detect head movement and, in response, adjust graphical content and an acoustic field presented to the person in a manner similar to how such views and sounds would change in a physical environment. As another example, the XR system may detect movement of the electronic device presenting the XR environment (e.g., a mobile phone, a tablet, a laptop, or the like) and, in response, adjust graphical content and an acoustic field presented to the person in a manner similar to how such views and sounds would change in a physical environment. In some situations (e.g., for accessibility reasons), the XR system may adjust characteristic(s) of graphical content in the XR environment in response to representations of physical motions (e.g., vocal commands).

There are many different types of electronic systems that enable a person to sense and/or interact with various XR environments. Examples include head mountable systems, projection-based systems, heads-up displays (HUDs), vehicle windshields having integrated display capability, windows having integrated display capability, displays formed as lenses designed to be placed on a person's eyes (e.g., similar to contact lenses), headphones/earphones, speaker arrays, input systems (e.g., wearable or handheld controllers with or without haptic feedback), smartphones, tablets, and desktop/laptop computers. A head mountable system may have one or more speaker(s) and an integrated opaque display. Alternatively, a head mountable system may be configured to accept an external opaque display (e.g., a smartphone). The head mountable system may incorporate one or more imaging sensors to capture images or video of the physical environment, and/or one or more microphones to capture audio of the physical environment. Rather than an opaque display, a head mountable system may have a transparent or translucent display. The transparent or translucent display may have a medium through which light representative of images is directed to a person's eyes. The display may utilize digital light projection, OLEDs, LEDs, uLEDs, liquid crystal on silicon, laser scanning light source, or any combination of these technologies. The medium may be an optical waveguide, a hologram medium, an optical combiner, an optical reflector, or any combination thereof. In some implementations, the transparent or translucent display may be configured to become opaque selectively. Projection-based systems may employ retinal projection technology that projects graphical images onto a person's retina. Projection systems also may be configured to project virtual objects into the physical environment, for example, as a hologram or on a physical surface.

FIG. 1 is a block diagram of an example of a portable multifunction device 100 (sometimes also referred to herein as the "electronic device 100" for the sake of brevity) in accordance with some implementations. The electronic device 100 includes memory 102 (which optionally includes one or more computer readable storage mediums), a memory controller 122, one or more processing units (CPUs) 120, a peripherals interface 118, an input/output (I/O) subsystem 106, an inertial measurement unit (IMU) 130, image sensor (s) 143 (e.g., a camera), a depth sensor 150, eye tracking sensor(s) 164, an ambient light sensor 190, and other input or control device(s) 116. In some implementations, the electronic device 100 corresponds to one of a mobile phone, tablet, laptop, wearable computing device, and/or the like.

In some implementations, the peripherals interface 118, the one or more CPUs 120, and the memory controller 122 are, optionally, implemented on a single chip, such as a chip 103. In some other implementations, they are, optionally, implemented on separate chips.

The I/O subsystem 106 couples input/output peripherals on the electronic device 100 and the other input or control devices 116 with the peripherals interface 118. The I/O subsystem 106 optionally includes an image sensor controller 158, an eye tracking controller 162, and one or more input controllers 160 for other input or control devices, and a privacy subsystem 170. The one or more input controllers 160 receive/send electrical signals from/to the other input or control devices 116. The other input or control devices 116 optionally include physical buttons (e.g., push buttons, rocker buttons, etc.), dials, slider switches, joysticks, click wheels, and so forth. In some alternate implementations, the one or more input controllers 160 are, optionally, coupled with any (or none) of the following: a keyboard, infrared port, Universal Serial Bus (USB) port, stylus, and/or a pointer device such as a mouse. The one or more buttons optionally include an up/down button for volume control of a speaker and/or audio sensor(s). The one or more buttons optionally include a push button. In some implementations, the other input or control devices 116 includes a positional system (e.g., GPS) that obtains information concerning the location and/or orientation of the electronic device 100 relative to a physical environment.

The I/O subsystem 106 optionally includes a speaker and audio sensor(s) that provide an audio interface between a user and the electronic device 100. Audio circuitry receives audio data from the peripherals interface 118, converts the audio data to an electrical signal, and transmits the electrical signal to the speaker. The speaker converts the electrical signal to human-audible sound waves. Audio circuitry also receives electrical signals converted by an audio sensor (e.g., a microphone) from sound waves. Audio circuitry converts the electrical signal to audio data and transmits the audio data to the peripherals interface 118 for processing. Audio data is, optionally, retrieved from and/or transmitted to the memory 102 and/or RF circuitry by the peripherals interface 118. In some implementations, audio circuitry also includes a headset jack. The headset jack provides an interface between audio circuitry and removable audio input/output peripherals, such as output-only headphones or a headset with both output (e.g., a headphone for one or both ears) and input (e.g., a microphone).

The I/O subsystem 106 optionally includes a touch-sensitive display system that provides an input interface and an output interface between the electronic device 100 and a user. A display controller may receive and/or send electrical signals from/to the touch-sensitive display system. The touch-sensitive display system displays visual output to the user. The visual output optionally includes graphics, text, icons, video, and any combination thereof (collectively termed "graphics"). In some implementations, some or all of the visual output corresponds to user interface objects. As used herein, the term "affordance" refers to a user-interactive graphical user interface object (e.g., a graphical user interface object that is configured to respond to inputs directed toward the graphical user interface object). Examples of user-interactive graphical user interface objects include, without limitation, a button, slider, icon, selectable menu item, switch, hyperlink, or other user interface control.

The touch-sensitive display system has a touch-sensitive surface, sensor, or set of sensors that accepts input from the user based on haptic and/or tactile contact. The touch-sensitive display system and the display controller (along with any associated modules and/or sets of instructions in the memory 102) detect contact (and any movement or breaking of the contact) on the touch-sensitive display system and converts the detected contact into interaction with user-interface objects (e.g., one or more soft keys, icons, web pages or images) that are displayed on the touch-sensitive display system. In an example implementation, a point of contact between the touch-sensitive display system and the user corresponds to a finger of the user or a stylus.

The touch-sensitive display system optionally uses LCD (liquid crystal display) technology, LPD (light emitting polymer display) technology, or LED (light emitting diode) technology, although other display technologies are used in other implementations. The touch-sensitive display system and the display controller optionally detect contact and any movement or breaking thereof using any of a plurality of touch sensing technologies now known or later developed, including but not limited to capacitive, resistive, infrared, and surface acoustic wave technologies, as well as other proximity sensor arrays or other elements for determining one or more points of contact with the touch-sensitive display system.

The user optionally makes contact with the touch-sensitive display system using any suitable object or appendage, such as a stylus, a finger, and so forth. In some implementations, the user interface is designed to work with finger-based contacts and gestures, which can be less precise than stylus-based input due to the larger area of contact of a finger on the touch screen. In some implementations, the electronic device 100 translates the rough finger-based input into a precise pointer/cursor position or command for performing the actions desired by the user.

The I/O subsystem 106 includes the inertial measurement unit (IMU) 130 that may include accelerometers, gyroscopes, and/or magnetometers in order measure various forces, angular rates, and/or magnetic field information with respect to the electronic device 100. Accordingly, according to various implementations, the IMU 130 detects one or more positional change inputs of the electronic device 100, such as the electronic device 100 being shaken, rotated, moved in a particular direction, and/or the like. The IMU may 130 include accelerometers, gyroscopes, and/or magnetometers in order measure various forces, angular rates, and/or magnetic field information with respect to the electronic device 100. Accordingly, according to various implementations, the IMU 130 detects one or more positional change inputs of the electronic device 100, such as the electronic device 100 being shaken, rotated, moved in a particular direction, and/or the like.

The image sensor(s) 143 capture still images and/or video. In some implementations, an image sensor 143 is located on the back of the electronic device 100, opposite a touch screen on the front of the electronic device 100, so that the touch screen is enabled for use as a viewfinder for still and/or video image acquisition. In some implementations, another image sensor 143 is located on the front of the electronic device 100 so that the user's image is obtained (e.g., for selfies, for videoconferencing while the user views the other video conference participants on the touch screen, etc.). In some implementations, the image sensor(s) 143 includes one or more depth sensors. In some implementations, the image sensor(s) 143 includes a monochrome or color camera. In some implementations, the image sensor(s) 143 includes an RGB depth (RGB-D) sensor.

The I/O subsystem 106 optionally includes contact intensity sensors that detect intensity of contacts on the electronic device 100 (e.g., a touch input on a touch-sensitive surface of the electronic device 100). The contact intensity sensors may be coupled with an intensity sensor controller in the I/O subsystem 106. The contact intensity sensor(s) optionally include one or more piezoresistive strain gauges, capacitive force sensors, electric force sensors, piezoelectric force sensors, optical force sensors, capacitive touch-sensitive surfaces, or other intensity sensors (e.g., sensors used to measure the force (or pressure) of a contact on a touch-sensitive surface). The contact intensity sensor(s) receive contact intensity information (e.g., pressure information or a proxy for pressure information) from the physical environment. In some implementations, at least one contact intensity sensor is collocated with, or proximate to, a touch-sensitive surface of the electronic device 100. In some implementations, at least one contact intensity sensor is located on the back of the electronic device 100.

In some implementations, the depth sensor 150 is configured to obtain depth data, such as depth information characterizing an object within an obtained input image. For example, the depth sensor 150 corresponds to one of a structured light device, a time-of-flight device, and/or the like.

The eye tracking sensor(s) 164 detect eye gaze of a user of the electronic device 100 and generate eye tracking data indicative of the eye gaze of the user. In various implementations, the eye tracking data includes data indicative of a fixation point (e.g., point of regard) of the user on a display panel, such as a display panel within an electronic device.

The ambient light sensor (ALS) 190 detects ambient light from the physical environment. In some implementations, the ambient light sensor 190 is a color light sensor. In some implementations, the ambient light sensor 190 is a two-dimensional (2D) or a three-dimensional (3D) light sensor.

In various implementations, the electronic device 100 includes a privacy subsystem 170 that includes one or more privacy setting filters associated with user information, such as user information included in the eye gaze data and/or body position data associated with a user. In some implementations, the privacy subsystem 170 selectively prevents and/or limits the electronic device 100 or portions thereof from obtaining and/or transmitting the user information. To this end, the privacy subsystem 170 receives user preferences and/or selections from the user in response to prompting the user for the same. In some implementations, the privacy subsystem 170 prevents the electronic device 100 from obtaining and/or transmitting the user information unless and until the privacy subsystem 170 obtains informed consent from the user. In some implementations, the privacy subsystem 170 anonymizes (e.g., scrambles or obscures) certain types of user information. For example, the privacy subsystem 170 receives user inputs designating which types of user information the privacy subsystem 170 anonymizes. As another example, the privacy subsystem 170 anonymizes certain types of user information likely to include sensitive and/or identifying information, independent of user designation (e.g., automatically).

Figure 2A:
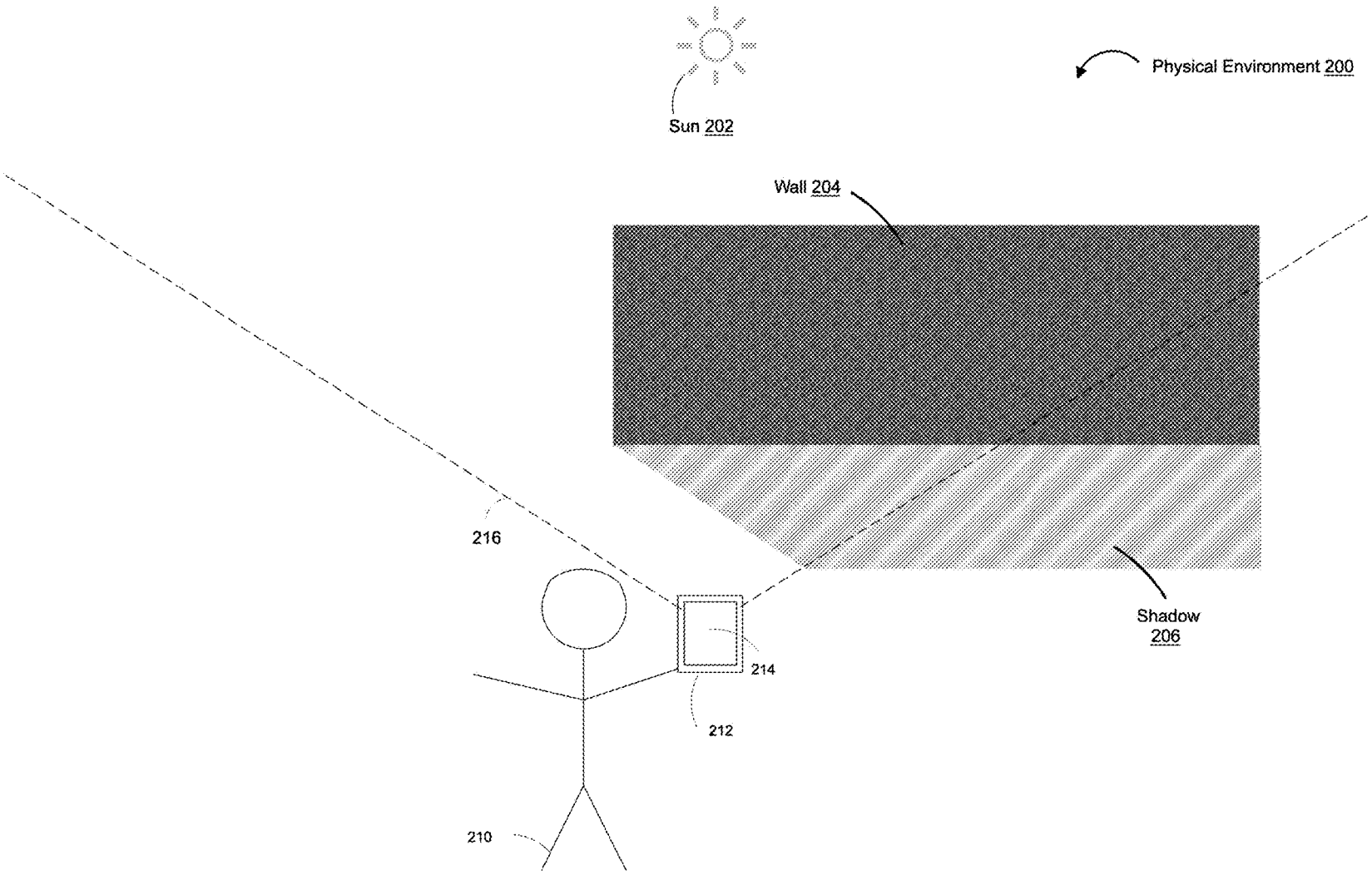
FIGS. 2A-2D are an example of light from a physical environment interfering with display of image data.

FIGS. 2A-2D are an example of light from a physical environment 200 interfering with display of image data. As illustrated in FIG. 2A, the physical environment 200 includes a sun 202, a physical wall 204, and a physical shadow 206. The physical shadow 206 is cast by the physical wall 204 based on the position of the sun 202 relative to the physical wall 204. The physical wall 204 and the physical shadow 206 include different patterns (e.g., different hatch patterns) in order to indicate that they have different luminance value and/or different color composition values (e.g., hue, chroma, saturation, etc.). For example, the physical wall 204 is red, whereas the physical shadow 206 is gray.

Figure 2B:
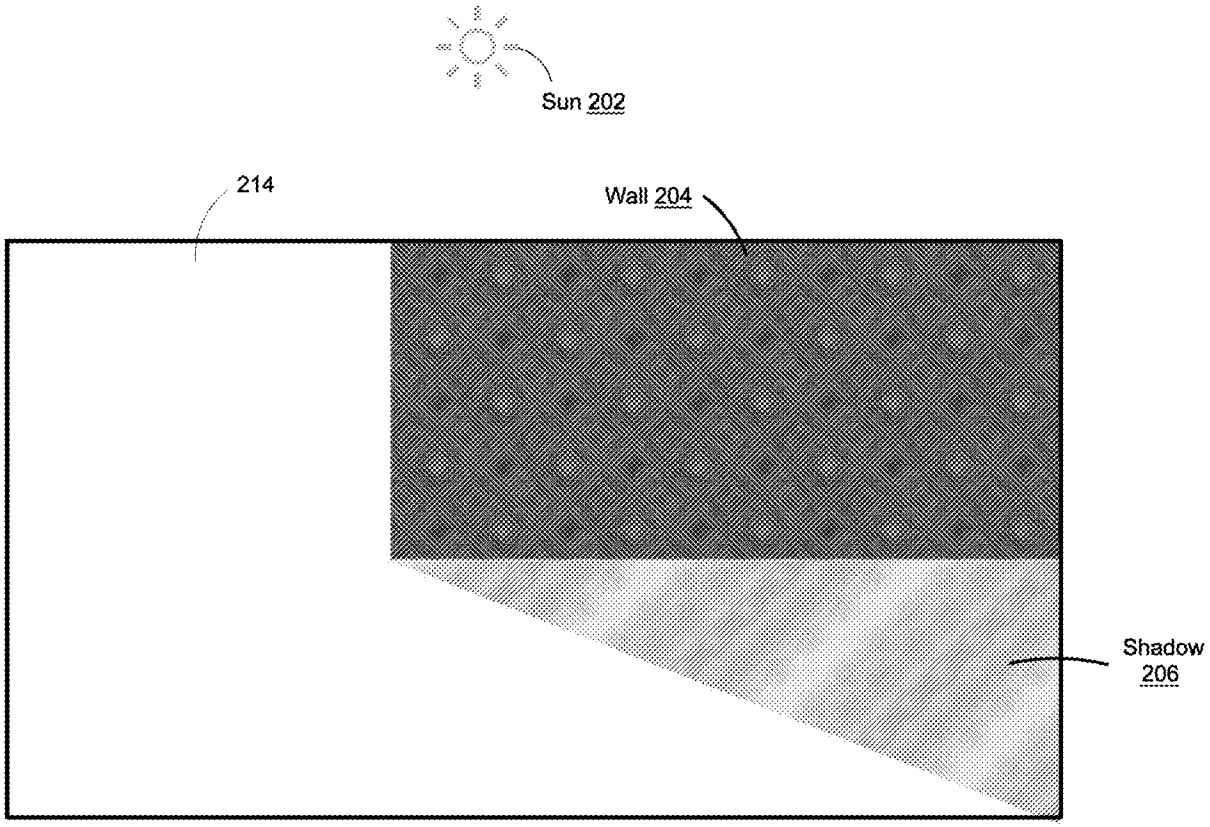

The physical environment 200 also includes a user 210 holding an electronic device 212 (e.g., a mobile device that includes a display 214. The display 214 is associated with a field-of-view 216. The field-of-view 216 includes the Sun 202, the physical wall 204, and the physical shadow 206. As illustrated in FIG. 2B, the display 214 displays the aforementioned features of the physical environment 200.

Figure 2C:
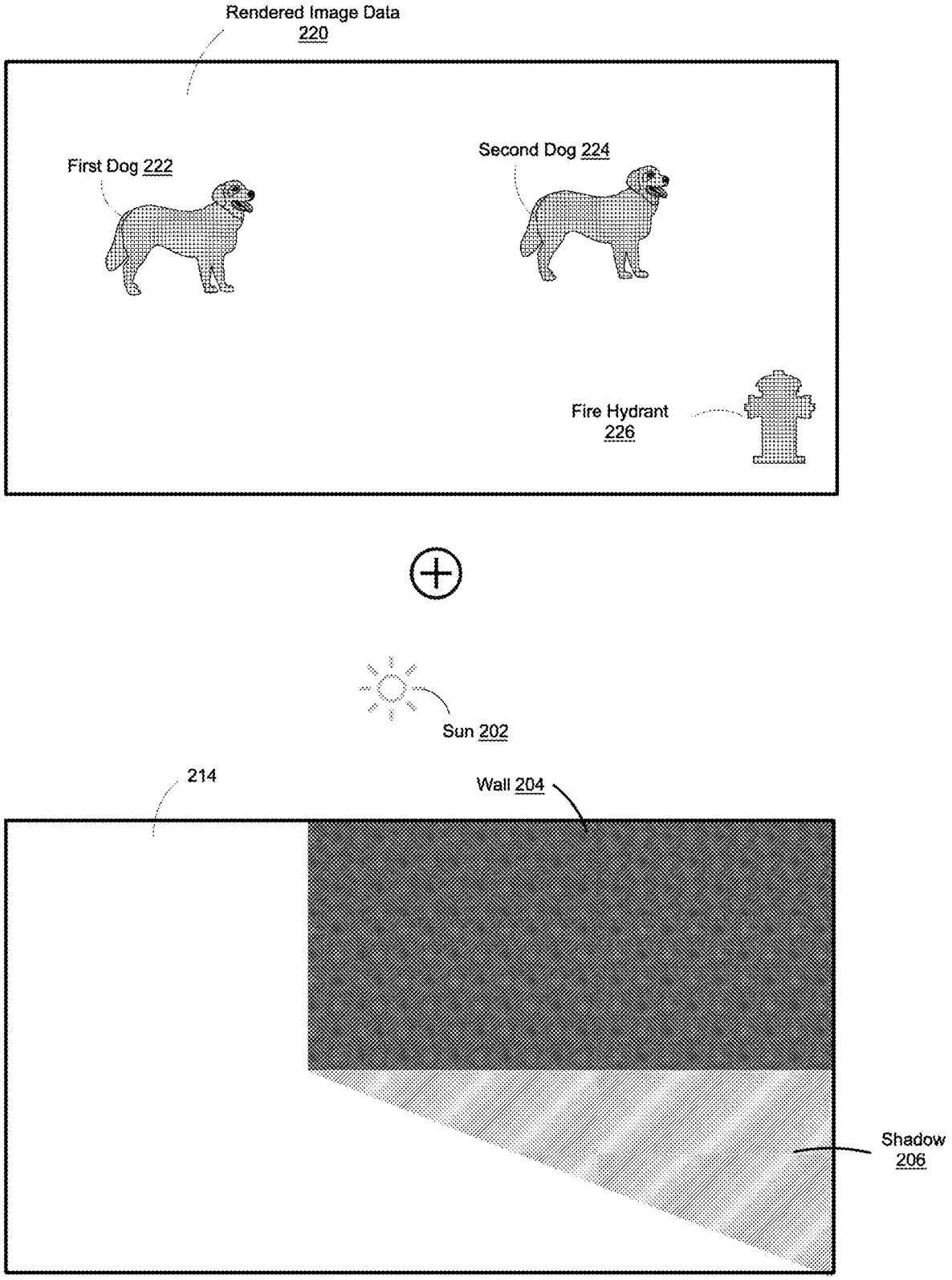

As illustrated in FIG. 2C, the electronic device 212 adds rendered image data 220 to the display 214, as indicated by the plus sign, which is illustrated for purely explanatory purposes. The rendered image data 220 represents a first dog 222, a second dog 224, and a fire hydrant 226. The first dog 222, the second dog 224, and the fire hydrant 226 have a common pattern. The common pattern is used in order to illustrate how ambient light from the sun 202 adversely affects display, by the display 214, of the image data, as will be described below. For example, the rendered image data 220 is output by a graphics processing unit (GPU).

Figure 2D:
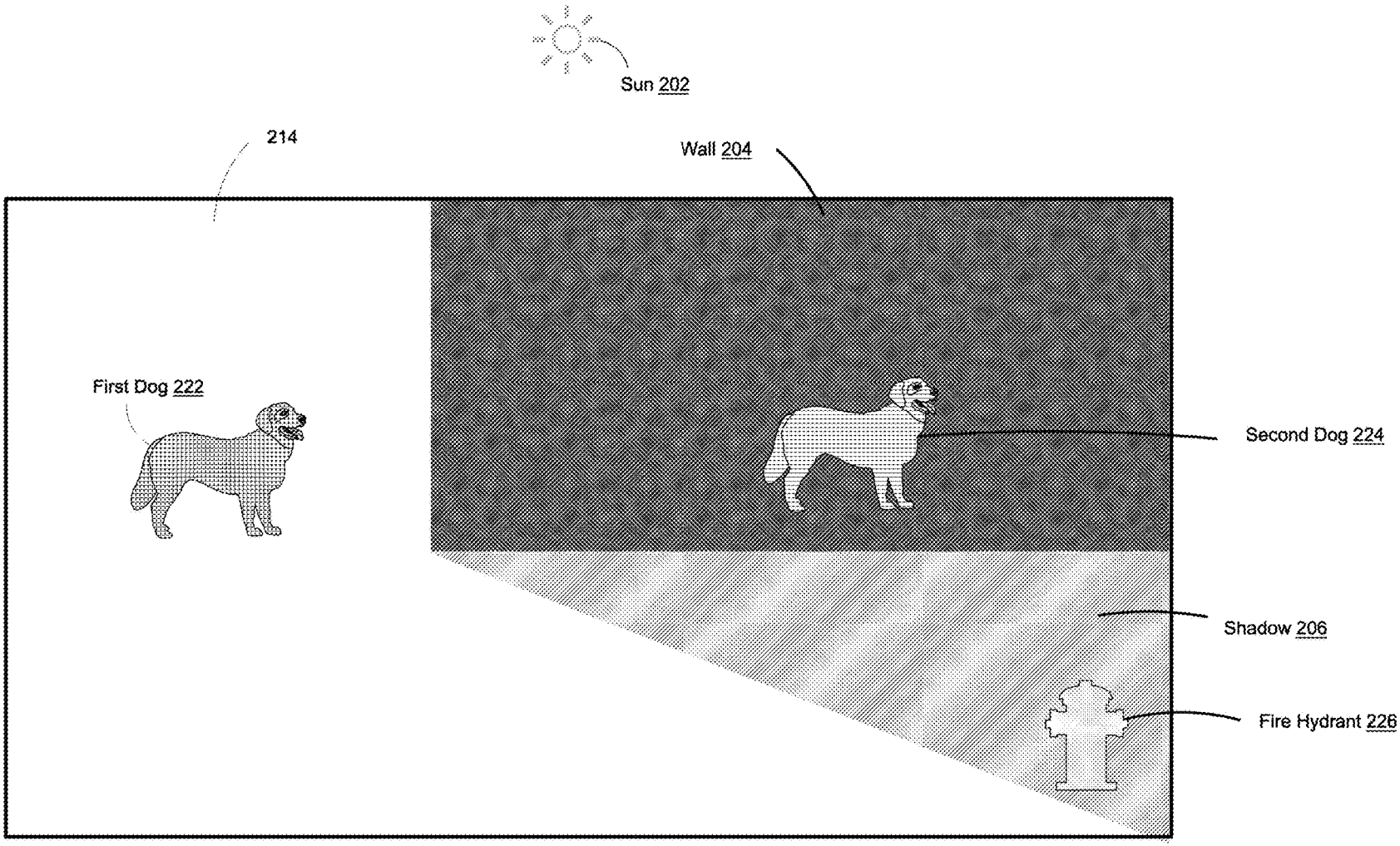

As illustrated in FIG. 2D, the electronic device 212 displays the rendered image data 220 on the display 214, such as by overlaying the rendered image data 220 onto features of the physical environment 200 (e.g., the physical wall 204 and the physical shadow 206). The first dog 222 has the common pattern described with reference to FIG. 2B, because neither the physical wall 204 nor the physical shadow 206 interfere display of the first dog 222. Namely, the first dog 222 is positioned at a portion of the display 214 that is not physically obscured by the physical wall 204 or the physical shadow 206.

However, ambient light from the physical environment 200 adversely affects display of the second dog 224 and the fire hydrant 226. Namely, the second dog 224 includes a first pattern that is different from the common pattern because the second dog 224 is positioned behind the physical wall 204. The fire hydrant 226 includes a second pattern that is different from the first pattern and the common pattern because the fire hydrant 226 is positioned within the physical shadow 206. For example, instead of the second dog 224 appearing with a white color (e.g., a Maltese-breed dog), the second dog 224 incorrectly appears with a greenish tint because the physical wall 204 is green colored. As another example, rather than appearing with a fire red color, the fire hydrant 226 incorrectly appears as a darker red color due to the physical shadow 206, resulting in less contrast between the fire hydrant 226 and the physical shadow 206.

FIGS. 3A-3H are an example of generating display data based on modified ambient light luminance values in accordance with some implementations. In various implementations, the features described with reference to FIGS. 3A-3H are performed by an electronic device including a display 314, such as the electronic device 100 illustrated in FIG. 1. In various implementations, the features described with reference to FIGS. 3A-3H are performed by a head-mountable device (HMD) that includes an integrated see-through display (e.g., a built-in display). In some implementations, the display 314 corresponds to a see-through display.

Figure 3A:
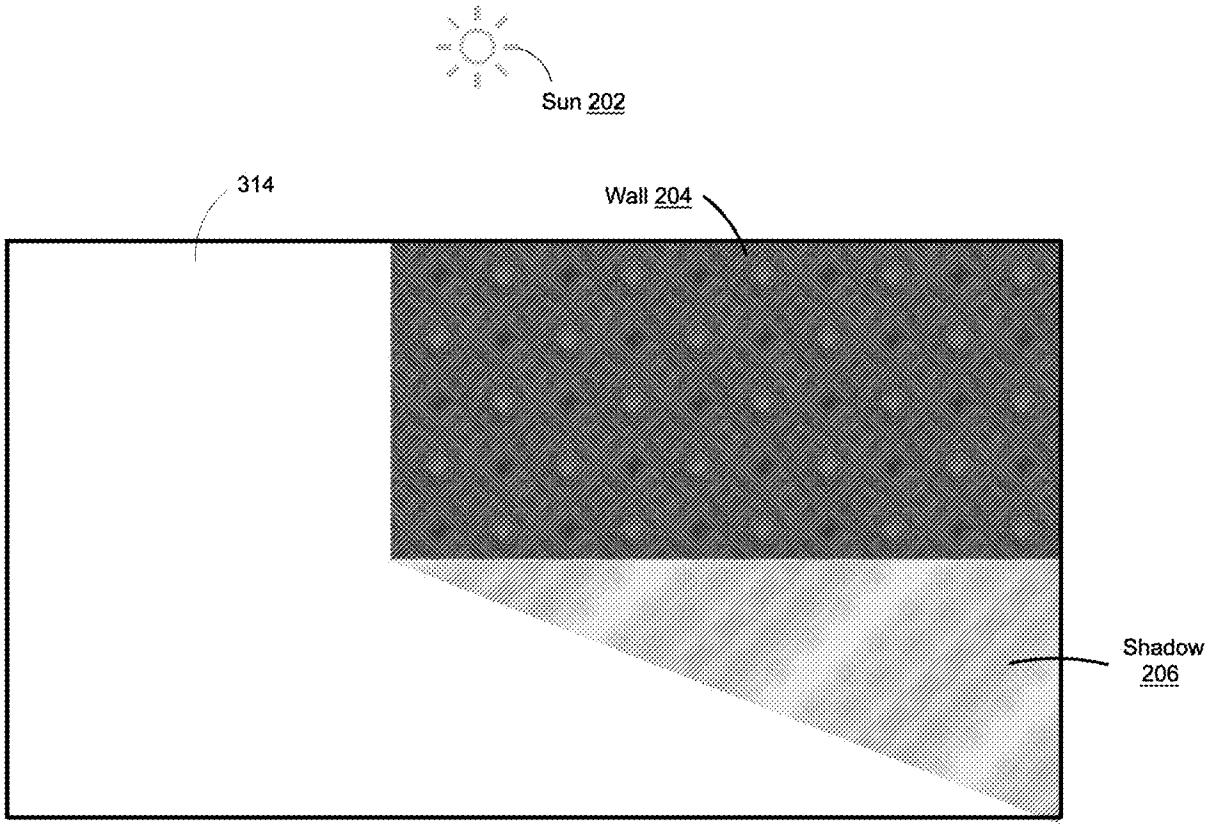
FIGS. 3A-3H are an example of generating display data based on modified ambient light luminance values in accordance with some implementations.

As illustrated in FIG. 3A, the electronic device displays, on the display 314, the physical wall 204 and the physical shadow 206 within the physical environment 200, as described with reference to FIGS. 2A and 2B.

Figure 3B:
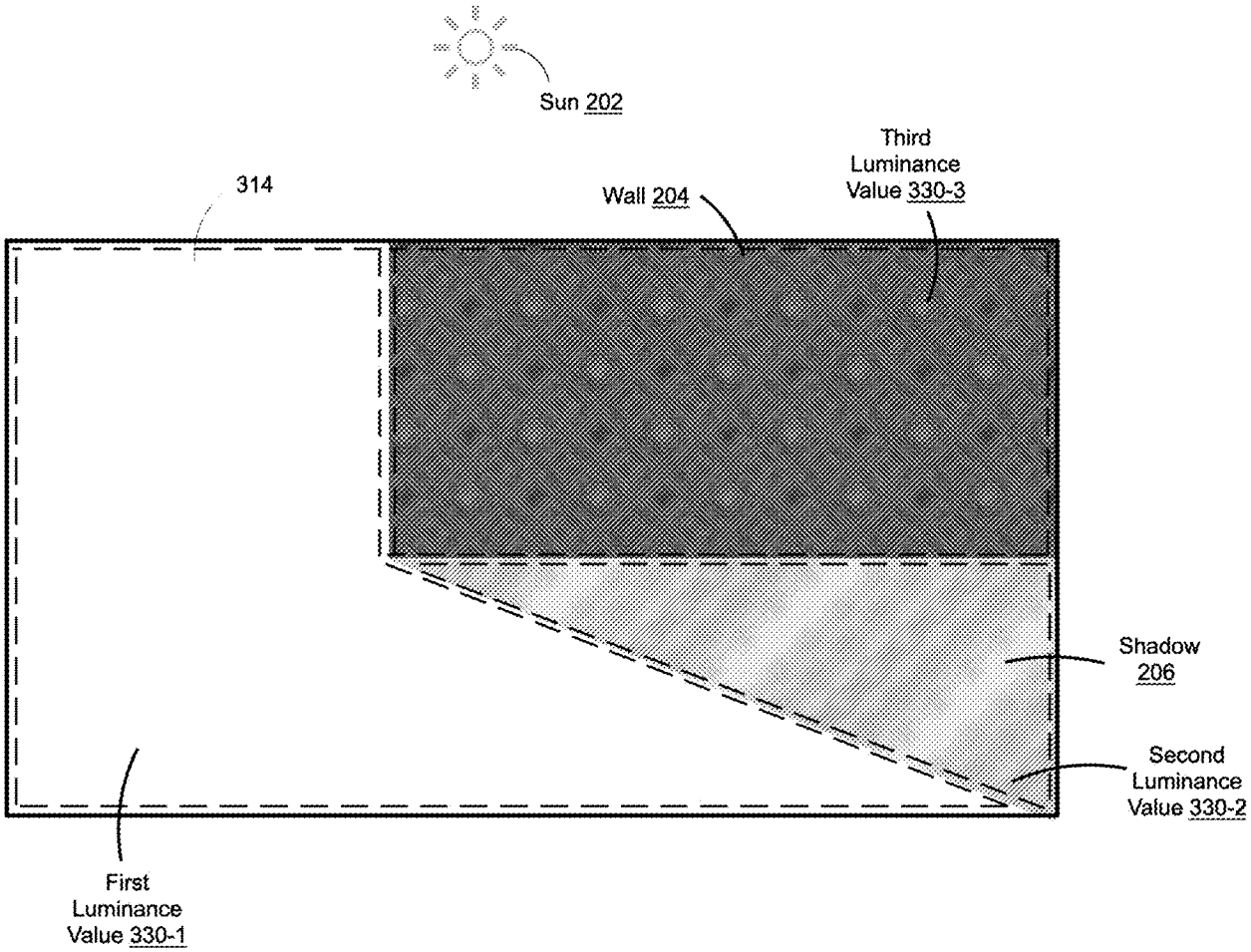

The electronic device senses a plurality of luminance values associated with ambient light from the physical environment 200. The plurality of luminance values quantifies the ambient light arriving at the display 314. For example, in some implementations, the electronic device includes one or both of an ambient light sensor (e.g., the ambient light sensor 190 in FIG. 1) and image sensor(s) (e.g., the image sensor(s) 143 in FIG. 1) in order to sense the plurality of luminance values. For example, as illustrated in FIG. 3B, the plurality of luminance values includes a first luminance value 330-1 that characterizes ambient light arriving at the left portion of the display 314. The plurality of luminance values includes a second luminance value 330-2 that characterizes ambient light arriving at a portion of the display 314 corresponding to the physical shadow 206. The plurality of luminance values includes a third luminance value 330-3 that characterizes ambient light arriving at a portion of the display 314 corresponding to the physical wall 204. Because the first luminance value 330-1 is associated with a portion of the physical environment 200 that is unobstructed by the physical wall 204 and the physical shadow 206, more light from the sun 202 reaches the portion of the physical environment 200. Accordingly, the first luminance value 330-1 is greater than the second luminance value 330-2 and the third luminance value 330-3. Moreover, because the second luminance value 330-2 is associated with a portion of the physical environment 200 including the physical shadow 206, which is cast by the physical wall 204, the second luminance value 330-2 is greater than the third luminance value 330-3.

Figure 3C:
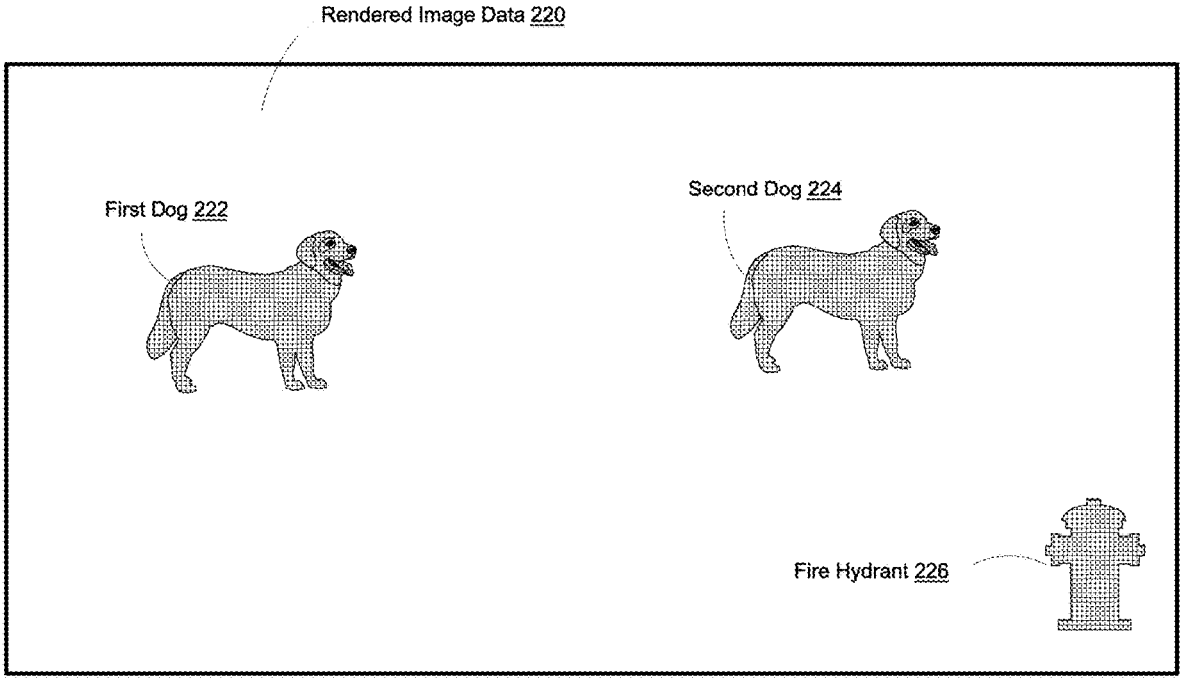
Figure 3D:
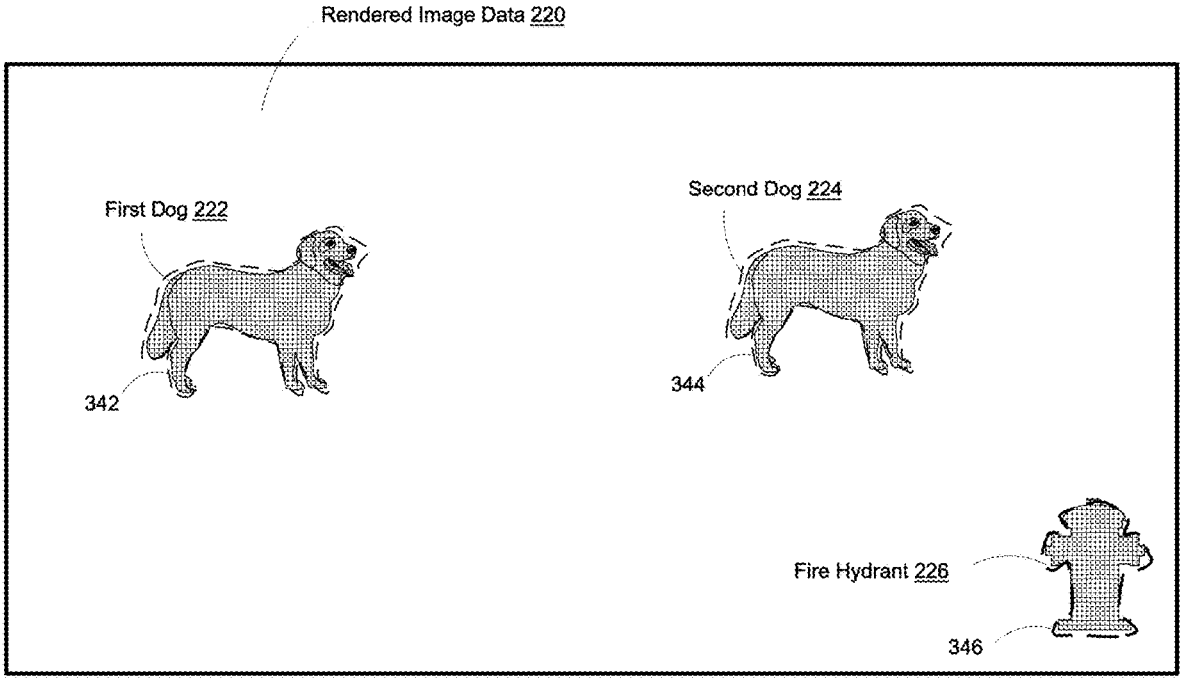
Figure 3E:
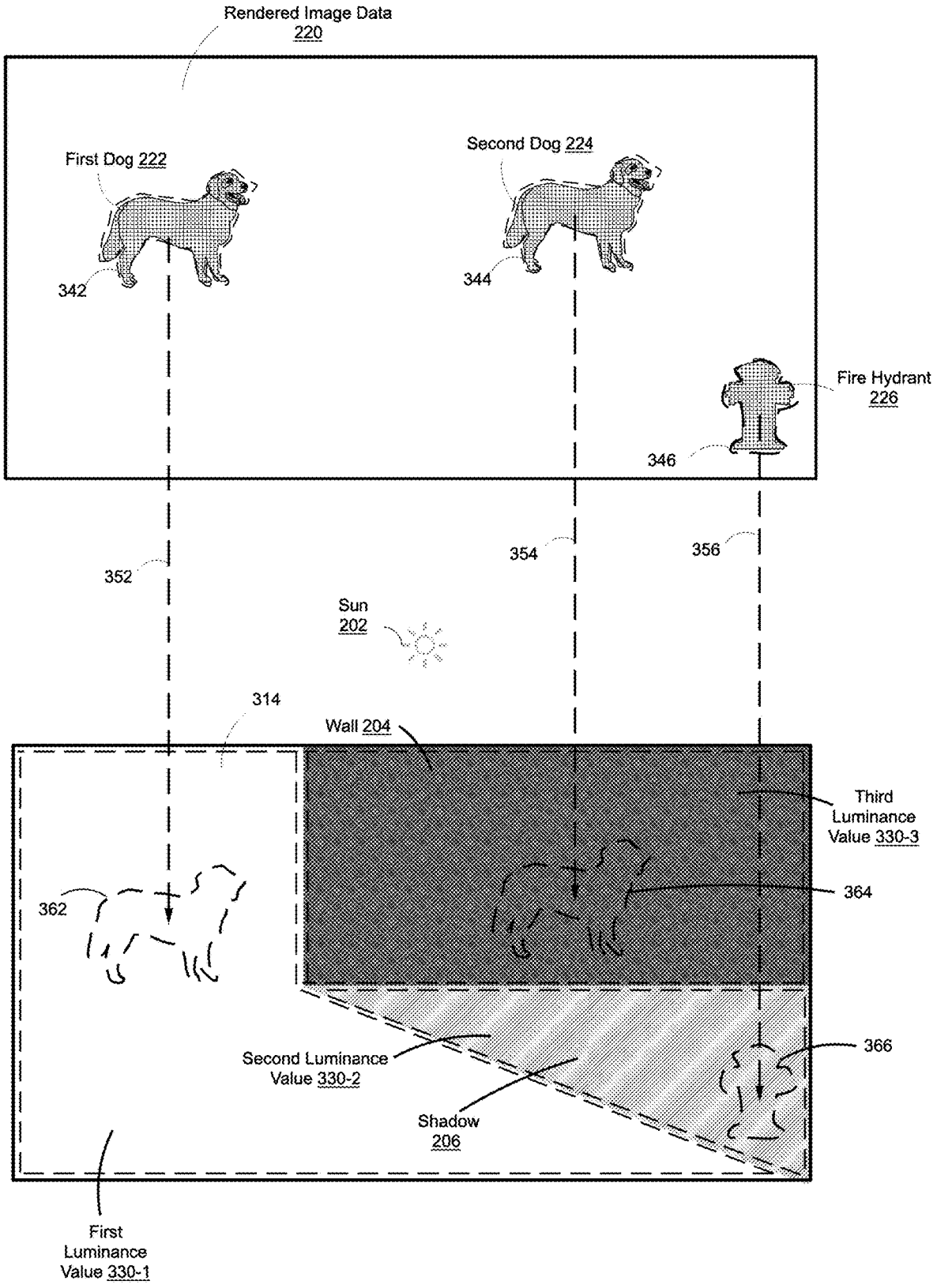

FIG. 3C illustrates the rendered image data 220, which is described with reference to FIG. 2C. Notably, the first dog 222, the second dog 224, and the fire hydrant 226 share a common pattern (e.g., common hatch pattern), as discussed above. Further discussion of the rendered image data 220 is omitted for the sake of brevity.

The electronic device identifies respective portions of the plurality of luminance values, across the display 314, based on corresponding portions of rendered image data. In some implementations, the electronic device identifies an object represented by the rendered image data 220. In some implementations, the electronic device identifies a background (e.g., scene background) represented by the rendered image data 220. For example, in some implementations, the electronic device utilizes a combination of instance segmentation and semantic segmentation in order to identify the object and/or the background. For example, with reference to FIG. 3D, the electronic device identifies the first dog 222, as is indicated by a first outline 342 (illustrated for purely explanatory purposes). The electronic device identifies the second dog 224, as is indicated by a second outline 344 (illustrated for purely explanatory purposes). The electronic device identifies the fire hydrant 226, as is indicated by a third outline 346 (illustrated for purely explanatory purposes).

Figure 3F:
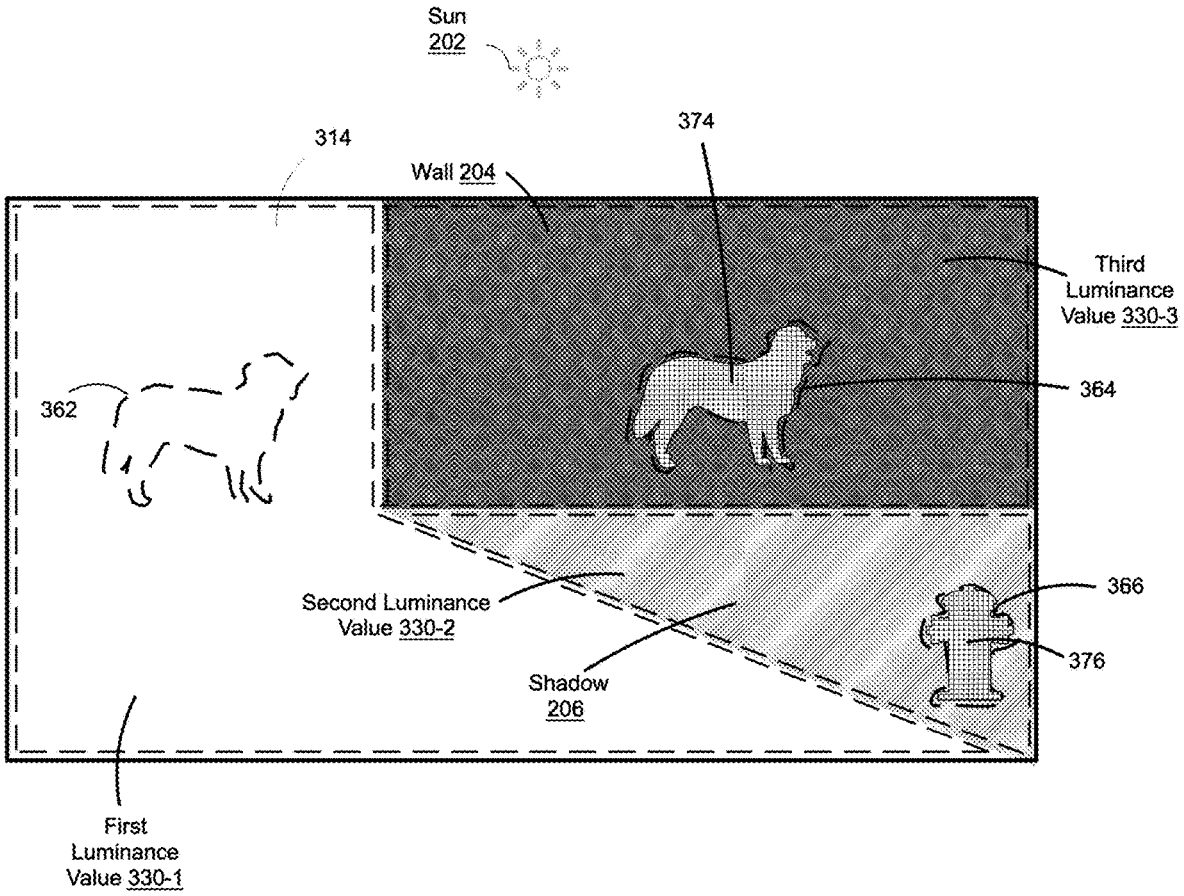

The electronic device modifies one or more of the respective portions of the plurality of luminance values based on a function of predetermined display characteristics associated with the rendered image data, in order to generate one or more modified portions of the plurality of luminance values. In some implementations, the predetermined display characteristics include a predetermined chromaticity characteristic and/or a tonal range characteristic. For example, with reference to FIG. 3E, based on the object identification, the electronic device demarcates (e.g., selects) respective regions of the display 314. Namely, the electronic device demarcates a first region 362 corresponding to the first outline 342 of the first dog 222, a second region 364 corresponding to the second outline 344 of the second dog 224, and a third region 366 corresponding to the third outline 346 of the fire hydrant 226. The electronic device modifies respective portions of the plurality of luminance values associated with the three regions (362, 364, and 366), based on the function of the predetermined display characteristics. Namely, with reference to FIG. 3F, the electronic device changes the second region 364 from the third luminance value 330-3 to a fourth luminance value 374. The difference in luminance values is indicated in FIG. 3F by the second region 364 having a pattern that is different from a pattern associated with a region of the physical wall 204 that is outside of the second region 364. For example, when the physical wall 204 is green colored and the second dog 224 is a white color (e.g., a Maltese-breed dog), the fourth luminance value 374 is such to prevent the second dog 224 from having a greenish tint via color mixing with the physical wall 204. As another example, the fourth luminance value 374 has a higher luminance than the third luminance value 330-3 in order to account for the blocking of the sun 202 by the physical wall 204. Moreover, the electronic device changes the third region 366 from the second luminance value 330-2 to a fifth luminance value 376. The difference in luminance values is indicated in FIG. 3F by the third region 366 having a pattern that is different from a pattern associated with a region of the physical shadow 206 that is outside of the third region 366. For example, the fifth luminance value 376 has a higher luminance than the second luminance value 330-2 because the fire hydrant 226 is to be displayed within the darker, physical shadow 206.

On the other hand, in some implementations, the electronic device foregoes changing the first luminance value 330-1 at a location corresponding to the first region 362 (e.g., where the first dog 222 is to be displayed), because the physical wall 204 does not block sunlight from the sun 202 reaching the first region 362. Accordingly, in some implementations, the electronic device reduces resource utilization by modifying a subset of the plurality of luminance values.

Figure 3G:
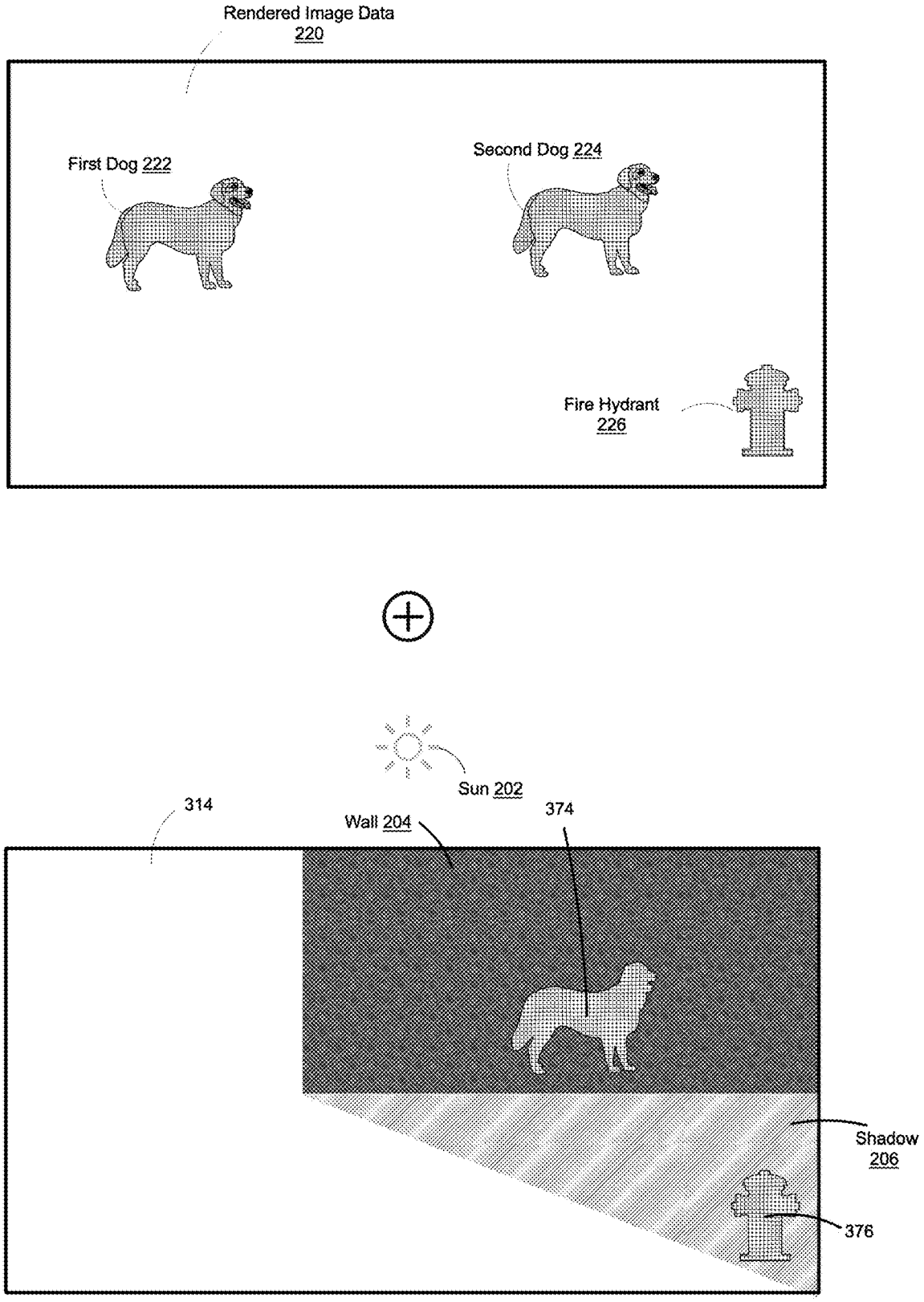
Figure 3H:
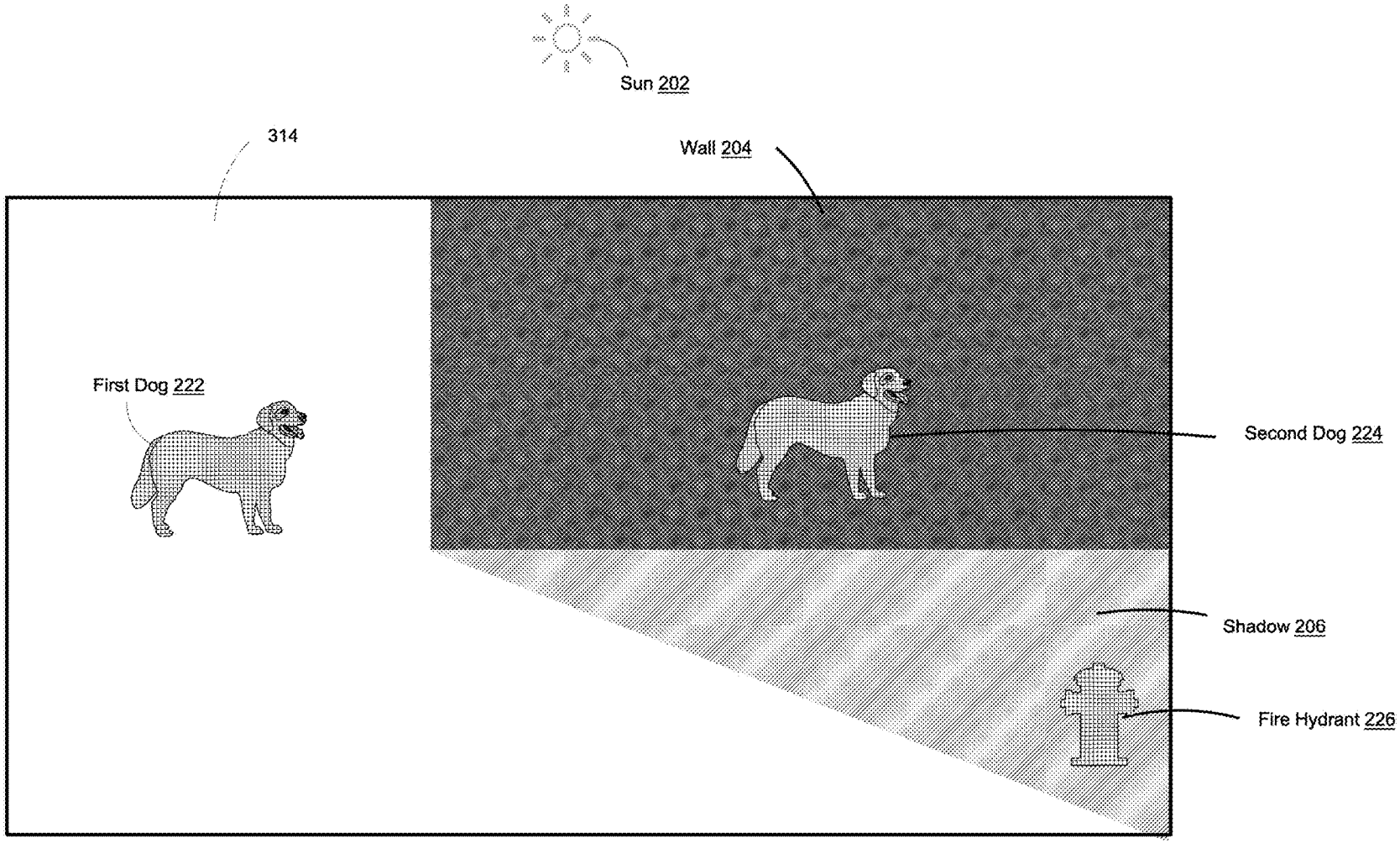

As illustrated in FIG. 3G, the electronic device modifies the rendered image 220 in order to generate display data, based on the modified luminance values corresponding to the fourth luminance value 374 and the fifth luminance value 376, as indicated by the plus sign, which is illustrated for purely explanatory purposes. Accordingly, the electronic device displays, on the see-through display, the display data. For example, with reference to FIG. 3H, the display 314 displays the display data. Notably, because of the aforementioned modifications to the rendered image data, the displayed first dog 222, the second dog 224, and the fire hydrant 226, share the common pattern in FIG. 3H, as was described with reference to the rendered image data 220 in FIG. 3C. In some implementations, each of the displayed first dog 222, the second dog 224, and the fire hydrant 226 have an appearance that matches a corresponding object within the rendered image data 220 within a performance threshold. Thus, the resulting displayed display data appears as though there is a nominal amount of ambient light from the physical environment 200. The appearance of the displayed display data is in contrast to an appearance of the displayed rendered image data 220 illustrated in FIG. 2D, in which some or all of the objects have been distorted, color-shifted, contrast-reduced, or otherwise adversely interfered with by the ambient light from the physical environment 200. Accordingly, the electronic device described with reference to FIGS. 3A-3H provides a better user-experience because the display data displayed on the display 314 more faithfully represents the corresponding rendered image data 220.

Figure 4:
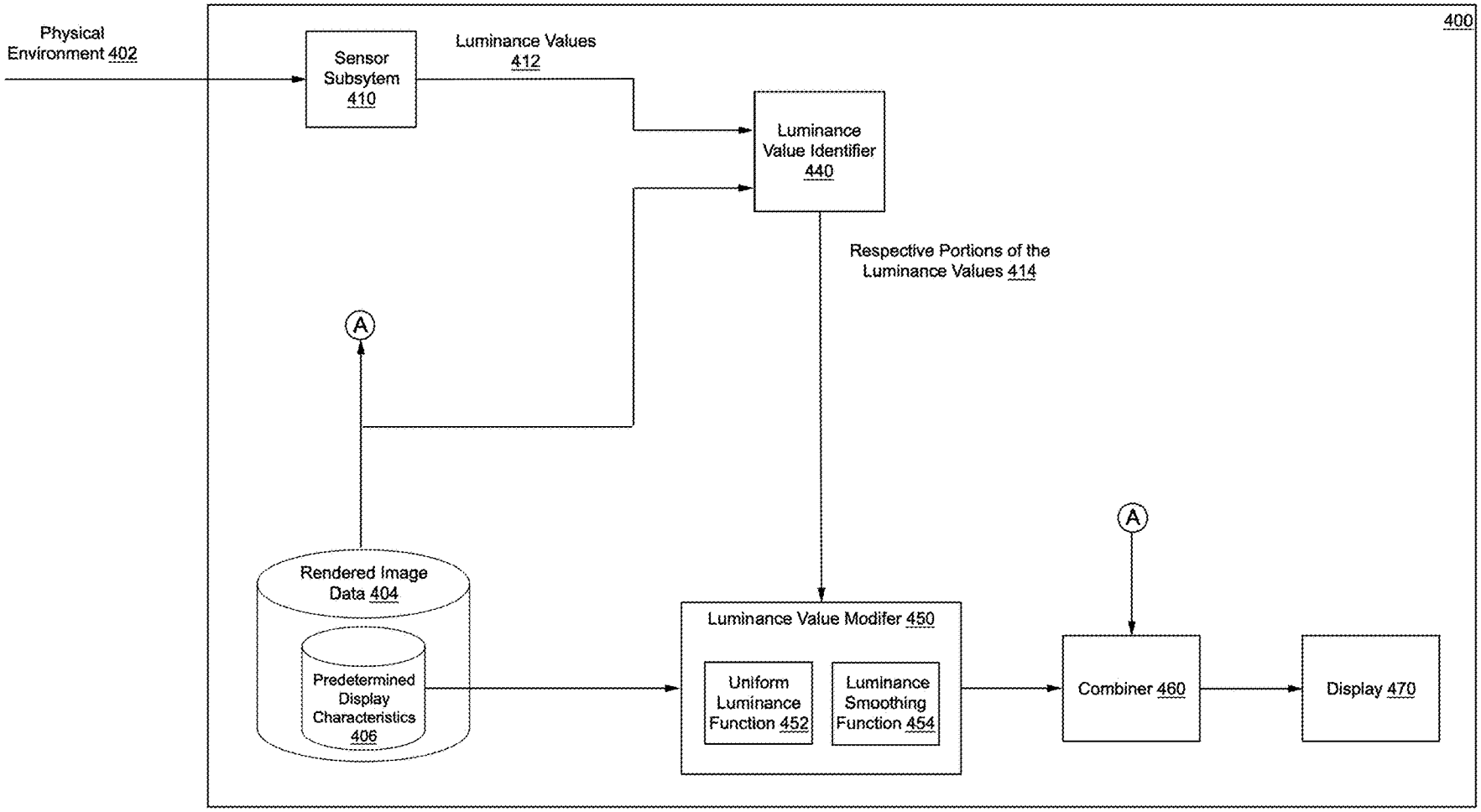
FIG. 4 is an example of a block diagram of a system for generating display data based on modified ambient light luminance values in accordance with some implementations.

FIG. 4 is an example of a block diagram of a system 400 for generating display data based on modified ambient light luminance values in accordance with some implementations. According to various implementations, the system 400, or components thereof, is similar to and adapted from corresponding components of the electronic device 100 illustrated in FIG. 1. According to various implementations, the system 400 is similar to and adapted from the electronic device described with reference to FIGS. 3A-3H. In various implementations, the system 400 or components thereof are integrated within a head-mountable device (HMD) including a display 470, such as a see-through display.

In some implementations, the system 400 includes a sensor subsystem 410 that senses a plurality of luminance values 412. The plurality of luminance values 412 quantifies ambient light from a physical environment 402 arriving at the display 470. The display 470 is integrated in the system 400. For example, with reference to FIG. 3B, the sensor subsystem 410 senses different luminance values 330-1-330-3 associated with different portion of the physical environment 200. In some implementations, the sensor subsystem 410 includes a combination of sensors, such as an ambient light sensor (ALS) (e.g., a two-dimensional (2D) sensor), an image sensor, a depth sensor (e.g., a time of flight sensor), and/or an inertial measurement unit (IMU). For example, in some implementations, the sensor subsystem 410 includes a monochrome or color camera with a depth sensor (RGB-D) and determines camera pose to point-of-view projection based on data from the RGB-D. As another example, in some implementations, the sensor subsystem 410 captures a lower resolution scene image, such as via a dedicated low-resolution image sensor or a dedicated high-resolution image sensor. In some implementations, the sensor subsystem 410 is implemented as a hardened IP block. In some implementations, the sensor subsystem 410 is implemented by using software and hardware accelerators.

The system 400 includes a luminance value identifier 440. The luminance value identifier 440 identifies and outputs respective portions of the plurality of luminance values 414, across the display 470, based on corresponding portions of rendered image data. For example, the rendered image data correspond to a sequence of image frames, such as a video stream. In some implementations, the system 400 obtains or generates (e.g., via a GPU integrated in the system 400) the rendered image data, and buffers the rendered image data in a rendered image data datastore 404. For example, the system 400 retrieves the rendered image data from the rendered image data datastore 404 in order to provide the rendered image data to the luminance value identifier 440. In some implementations, the system 400 foregoes buffering the rendered image data. For example, with reference to FIGS. 3D and 3E, the luminance value identifier 440 identifies the first region 362 having the first luminance value 330-1, the second region 364 having the third luminance value 330-3, and the third region 366 having the second luminance value 330-2.

The system 400 includes a luminance value modifier 450. The luminance value modifier 450 modifies the one or more of the respective portions of the plurality of luminance values 414 based on a function of predetermined display characteristics associated with the rendered image data, in order to generate one or more modified portions of the plurality of luminance values. In some implementations, the system 400 stores the predetermined display characteristics within a predetermined display characteristics datastore 406, and retrieves therefrom. For example, with reference to FIG. 3F, the luminance value modifier 450 modifies the third luminance value 330-3 in order to generate a fourth luminance value 374, based on predetermined display characteristics associated with a portion of the rendered image data 220 corresponding to the second dog 224. As one example, the predetermined display characteristics associated with the second dog 224 includes a color composition and luminance of a preferred appearance of the second dog 224, such as a substantially black color for a black Labrador dog.

In some implementations, the luminance value modifier 450 includes a uniform luminance function 452, which is applied to the respective portions of the plurality of luminance values 414. For example, the respective portions of the plurality of luminance values 414 include a location on the display 470 where a face (as represented by generated display data) is to be displayed. Continuing with this example, the uniform luminance function 452 generates a modified luminance value that is used to modify the face such that the appearance of the modified face, when displayed, has a substantially uniform skin tone. As another example, in some implementations, the uniform luminance function 452 flattens the respective portions of the plurality of luminance values 414.

In some implementations, the luminance value modifier 450 includes a luminance smoothing function 454, which is applied to the respective portions of the plurality of luminance values 414. For example, the system 400 applies the luminance smoothing function 454 to a location on the display 470 where a scene background (as represented by generated display data) is to be displayed. Continuing with this example, the luminance smoothing function 454 generates a modified luminance value that is used to modify the background such that the modified background, when displayed on the display 470, has a substantially smooth (e.g., relatively low variance in luminance range) visual characteristic.

In some implementations, the system 400 includes a combiner 460 that modifies the corresponding portions of the rendered image data in order to generate display data, based on the one or more modified portions of the plurality of luminance values. The combiner 460 outputs the display data to the display 470 for display.

Figure 5:
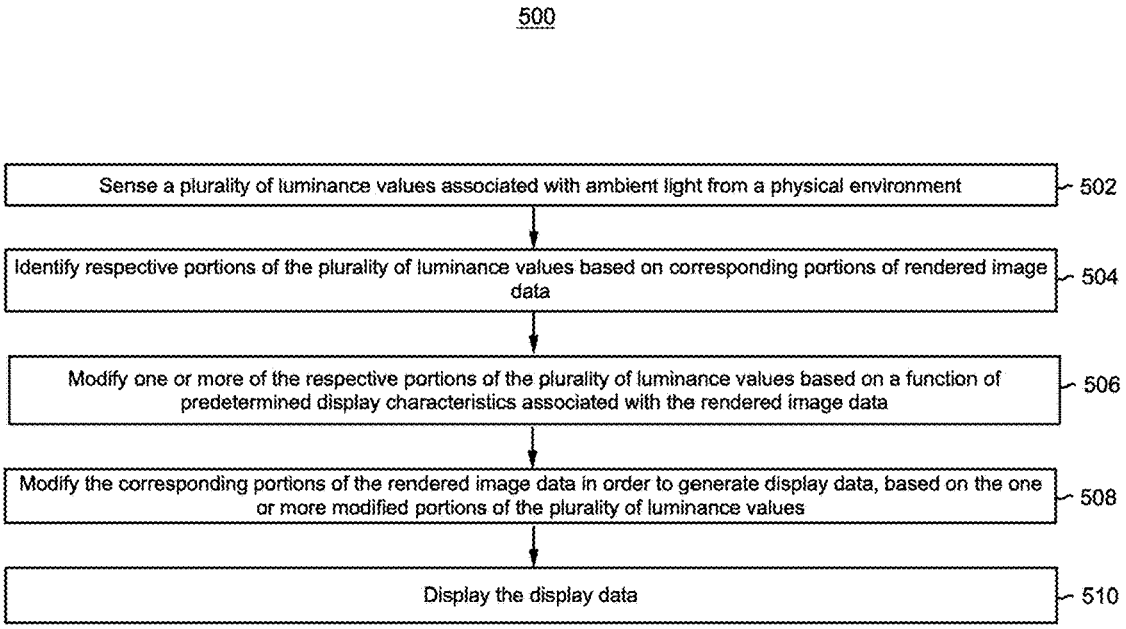
FIG. 5 is an example of a flow diagram of a method of generating display data based on modified ambient light luminance values in accordance with some implementations.

FIG. 5 is an example of a flow diagram of a method 500 of generating display data based on modified ambient light luminance values in accordance with some implementations. In various implementations, the method 500 or portions thereof are performed by an electronic device (e.g., the electronic device 100 in FIG. 1 or the electronic device described with reference to FIGS. 3A-3H). In various implementations, the method 500 or portions thereof are performed by the system 400. In various implementations, the method 500 or portions thereof are performed by a head-mountable device (HMD) including a see-through display. In some implementations, the method 500 is performed by processing logic, including hardware, firmware, software, or a combination thereof. In some implementations, the method 500 is performed by a processor executing code stored in a non-transitory computer-readable medium (e.g., a memory).

As represented by block 502, the method 500 includes sensing a plurality of luminance values associated with ambient light from a physical environment. The plurality of luminance values quantifies the ambient light arriving at the see-through display. For example, the plurality of luminance values is indicative of the brightness or intensity of the ambient light, such that each of the plurality of luminance values provides a luminance range of a corresponding portion of ambient light entering the see-through display. For example, with reference to FIG. 3B, the method 500 includes sensing different luminance values 330-1-330-3 associated with different portions of the physical environment 200.

As represented by block 504, the method 500 includes identifying respective portions of the plurality of luminance values, across the see-through display, based on corresponding portions of rendered image data. For example, with reference to FIGS. 3D and 3E, the method 500 includes identifying the first region 362 having the first luminance value 330-1, the second region 364 having the third luminance value 330-3, and the third region 366 having the third luminance value 330-3. In some implementations, the method 500 includes performing instance segmentation with respect to features represented by the rendered image data, in order to identify the respective portions of the plurality of luminance values. For example, the output of instance segmentation is an object identifier that does not provide an understanding or meaning associated with a corresponding object, such as "Object No. 1," "Object No. 2," etc. In some implementations, the method 500 includes performing semantic segmentation with respect to features represented by the rendered image data, in order to identify the respective portions of the plurality of luminance values. For example, the output of semantic segmentation is an object identifier that provides an understanding or meaning associated with a corresponding object, such as "Dog" or "White dog." In some implementations, the method 500 includes utilizing other computer-vision techniques in order to distinguish between a scene background and foreground object (s).

As represented by block 506, the method 500 includes modifying (e.g., preprocessing) one or more of the respective portions of the plurality of luminance values based on a function of predetermined display characteristics associated with the rendered image data, in order to generate one or more modified portions of the plurality of luminance values. For example, with reference to FIG. 3F, the luminance value modifier 450 modifies the second luminance value 330-2 in order to generate a fifth luminance value 376, based on predetermined display characteristics associated with a portion of the rendered image data 220 corresponding to the fire hydrant 226. As one example, the predetermined display characteristics associated with the fire hydrant 226 include a color composition and/or luminance of a preferred appearance of the fire hydrant 226, such as a relatively high chroma value when the fire hydrant 226 ought to be displayed with a fire engine red color.

As represented by block 508, the method 500 includes modifying the corresponding portions of the rendered image data in order to generate display data, based on the one or more modified portions of the plurality of luminance values. For example, the electronic device modifies the rendered image data 220 in order to generate display data based on the modified luminance values (374 and 376) as illustrated in FIG. 3G, and the electronic device displays, on the display 314, the display data in FIG. 3H.

As represented by block 510, the method 500 includes displaying, on the see-through display, the display data.

Figure 6:
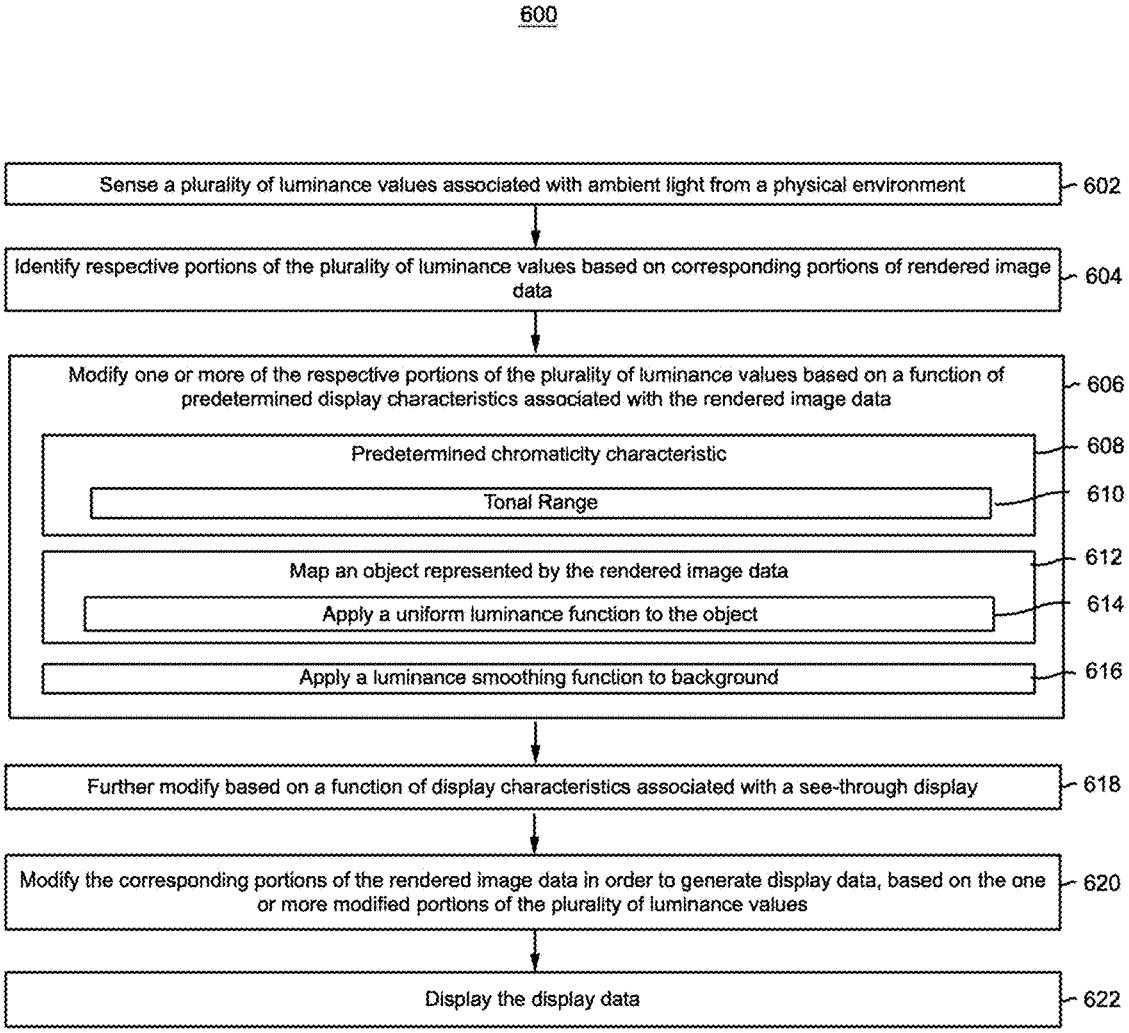
FIG. 6 is another example of a flow diagram of a method of generating display data based on modified ambient light luminance values in accordance with some implementations.

FIG. 6 is another example of a flow diagram of a method 600 of generating display data based on modified ambient light luminance values in accordance with some implementations. In various implementations, the method 600 or portions thereof are performed by an electronic device (e.g., the electronic device 100 in FIG. 1, the electronic device in FIGS. 3A-3H). In various implementations, the method 600 or portions thereof are performed by the system 400. In various implementations, the method 600 or portions thereof are performed by a head-mountable device (HMD) including a see-through display. In some implementations, the method 600 is performed by processing logic, including hardware, firmware, software, or a combination thereof. In some implementations, the method 600 is performed by a processor executing code stored in a non-transitory computer-readable medium (e.g., a memory).

As represented by block 602, the method 600 includes sensing a plurality of luminance values associated with ambient light from a physical environment. The plurality of luminance values quantifies the ambient light arriving at the see-through display. For example, with reference to FIG. 3B, the method 600 includes sensing different luminance values 330-1-330-3 associated with different portions of the physical environment 200.

As represented by block 604, the method 600 includes identifying respective portions of the plurality of luminance values, across the see-through display, based on corresponding portions of rendered image data. For example, with reference to FIGS. 3D and 3E, the method 600 includes identifying the first region 362 having the first luminance value 330-1, the second region 364 having the third luminance value 330-3, and the third region 366 having the third luminance value 330-3.

As represented by block 606, the method 600 includes modifying one or more of the respective portions of the plurality of luminance values based on a function of predetermined display characteristics associated with the rendered image data, in order to generate one or more modified portions of the plurality of luminance values. For example, the predetermined display characteristics include a luminance characteristic associated with the portion of the rendered image data, such as a relatively high luminance value for a portion of the rendered image data including a bright light. As another example, the predetermined display characteristics include a color composition characteristic, such as a combination of a hue characteristic, a chroma characteristic, a saturation characteristic, and/or the like. For example, with reference to FIG. 3F, the electronic modifies the third luminance value 330-3 in order to generate the fourth luminance value 374, based on predetermined display characteristics associated with a portion of the rendered image data 220 corresponding to the second dog 224.

In some implementations, as represented by block 608, the predetermined display characteristics include a predetermined chromaticity characteristic. For example, the predetermined chromaticity characteristic provides an objective specification of the quality of the color of the object. Predetermined chromaticity may indicate two independent parameters, often specified as hue and colorfulness. Colorfulness is sometimes referred to as saturation, chroma, intensity, or purity. As one example, when the rendered image data represents a face, the predetermined chromaticity characteristic includes an average skin tone across the face. For example, with reference to FIG. 3E, the fire hydrant 226 is associated with a predetermined chromaticity characteristic of red.

In some implementations, as represented by block 610, the predetermined display characteristics include a tonal range. For example, the tonal range is associated with a range of skin tones of a face represented by the rendered image data. For example, with reference to FIG. 3E, when the fire dog 222 is a Golden Retriever, the tonal range includes various shades of brown.

In some implementations, as represented by block 612, the predetermined display characteristics are associated with an object represented by the rendered image data, such as identified via using one or both of instance segmentation and semantic segmentation. For example, in some implementations, the object is of an object type that satisfies a criterion. As one example, the object type is an object of interest, such as a face, text, or a relatively large foreground object within a scene. As another example, the object type is a living object, such as a person, animal, plant, etc. In some implementations, as represented by block 614, modifying the one or more of the respective portions of the plurality of luminance values includes applying a uniform luminance function to the one or more of the respective portions of the plurality of luminance values, such as describe above with reference to the uniform luminance function 452 illustrated in FIG. 4. For example, the method 600 includes applying the uniform luminance function to an object represented by the rendered image data. In some implementations, as represented by block 614, modifying the one or more of the respective portions of the plurality of luminance values includes applying a luminance flattening function to the one or more of the respective portions of the plurality of luminance values. For example, with reference to FIG. 3E, the electronic device semantically identifies the first dog 222 as a "Golden Retriever," the second dog 224 as a "Labrador," and the fire hydrant 226 as a "Fire Hydrant."

In some implementations, as represented by block 616, the predetermined display characteristics are associated with a scene background represented within the rendered image data. Moreover, modifying the one or more of the respective portions of the plurality of luminance values includes applying a luminance smoothing function to the modifying the one or more of the respective portions of the plurality of luminance values. For example, the method 600 includes applying the luminance smoothing function to a scene background, which is represented by the rendered image data. In some implementations, the luminance smoothing function performs one or more of Gaussian smoothing, uniform moving average smoothing, and/or the like. Additional details regarding the operation of the luminance smoothing function are provided with reference to the luminance smoothing function 454 illustrated in FIG. 4. For example, with reference to FIGS. 3E and 3F, in some implementations, rather than modifying a luminance value based on a predetermined display characteristic associated with the first dog 222, the electronic device modifies the luminance value based on a predetermined display characteristic associated with a background of the scene relative to the first dog 222.

In some implementations, as represented by block 618, modifying the one or more of the respective portions of the plurality of luminance values is a further function of one or more display characteristics associated with the see-through display. For example, in some implementations, the one or more display characteristics include a gamut range associated with the see-through display. The gamut range may correspond to a display gamut characterizing the see-through display, corresponding to a range of colors that are displayable by the see-through display. As another example, in some implementations, the one or more display characteristics include a combination of lens characteristics (e.g., shape of lens), maximum display panel brightness, lens tint (e.g., amount of lens frosting), distance between lens and user's eyes, and/or the like. For example, with reference to FIG. 3E, in some implementations, the display gamut of the display 314 cannot display the entire range of the first luminance value 330-1 because the light from the sun 202 is too bright. Accordingly, the electronic device weighs the first luminance value 330-1 less the second luminance value 330-2 and the third luminance value 330-3 in order to modify the one or more of the respective portions of the plurality of luminance values.

As represented by block 620, the method 600 includes modifying the corresponding portions of the rendered image data in order to generate display data, based on the one or more modified portions of the plurality of luminance values. For example, the electronic device modifies the rendered image data 220 in order to generate display data based on the modified luminance values (374 and 376) as illustrated in FIG. 3G, and the electronic device displays, on the display 314, the display data in FIG. 3H.

As represented by block 622, the method 600 includes displaying, on the see-through display, the display data.

The present disclosure describes various features, no single one of which is solely responsible for the benefits described herein. It will be understood that various features described herein may be combined, modified, or omitted, as would be apparent to one of ordinary skill. Other combinations and sub-combinations than those specifically described herein will be apparent to one of ordinary skill, and are intended to form a part of this disclosure. Various methods are described herein in connection with various flowchart steps and/or phases. It will be understood that in many cases, certain steps and/or phases may be combined together such that multiple steps and/or phases shown in the flowcharts can be performed as a single step and/or phase. Also, certain steps and/or phases can be broken into additional sub-components to be performed separately. In some instances, the order of the steps and/or phases can be rearranged and certain steps and/or phases may be omitted entirely. Also, the methods described herein are to be understood to be open-ended, such that additional steps and/or phases to those shown and described herein can also be performed.

Some or all of the methods and tasks described herein may be performed and fully automated by a computer system. The computer system may, in some cases, include multiple distinct computers or computing devices (e.g., physical servers, workstations, storage arrays, etc.) that communicate and interoperate over a network to perform the described functions. Each such computing device typically includes a processor (or multiple processors) that executes program instructions or modules stored in a memory or other non-transitory computer-readable storage medium or device. The various functions disclosed herein may be implemented in such program instructions, although some or all of the disclosed functions may alternatively be implemented in application-specific circuitry (e.g., ASICs or FPGAs or GP-GPUs) of the computer system. Where the computer system includes multiple computing devices, these devices may be co-located or not co-located. The results of the disclosed methods and tasks may be persistently stored by transforming physical storage devices, such as solid-state memory chips and/or magnetic disks, into a different state.

Various processes defined herein consider the option of obtaining and utilizing a user's personal information. For example, such personal information may be utilized in order to provide an improved privacy screen on an electronic device. However, to the extent such personal information is collected, such information should be obtained with the user's informed consent. As described herein, the user should have knowledge of and control over the use of their personal information.

Personal information will be utilized by appropriate parties only for legitimate and reasonable purposes. Those parties utilizing such information will adhere to privacy policies and practices that are at least in accordance with appropriate laws and regulations. In addition, such policies are to be well-established, user-accessible, and recognized as in compliance with or above governmental/industry standards. Moreover, these parties will not distribute, sell, or otherwise share such information outside of any reasonable and legitimate purposes.

Users may, however, limit the degree to which such parties may access or otherwise obtain personal information. For instance, settings or other preferences may be adjusted such that users can decide whether their personal information can be accessed by various entities. Furthermore, while some features defined herein are described in the context of using personal information, various aspects of these features can be implemented without the need to use such information. As an example, if user preferences, account names, and/or location history are gathered, this information can be obscured or otherwise generalized such that the information does not identify the respective user.

The disclosure is not intended to be limited to the implementations shown herein. Various modifications to the implementations described in this disclosure may be readily apparent to those skilled in the art, and the generic principles defined herein may be applied to other implementations without departing from the spirit or scope of this disclosure. The teachings of the invention provided herein can be applied to other methods and systems, and are not limited to the methods and systems described above, and elements and acts of the various implementations described above can be combined to provide further implementations. Accordingly, the novel methods and systems described herein may be implemented in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed:

1. A method comprising:

at an electronic device including one or more processors, a non-transitory memory, and a see-through display:

obtaining a rendered image that has predetermined display characteristics, wherein the rendered image includes a plurality of portions;

sensing a plurality of luminance values associated with ambient light from a physical environment, wherein the plurality of luminance values quantifies the ambient light arriving at the see-through display;

associating each of the plurality of luminance values with a corresponding portion of the plurality of portions of the rendered image;

modifying one or more of the plurality of luminance values based on a function of the association and the predetermined display characteristics, in order to generate one or more modified portions of the plurality of luminance values;

modifying the corresponding portions of the rendered image in order to generate display data, based on the one or more modified portions of the plurality of luminance values; and displaying, on the see-through display, the display data.

2. The method of claim 1, wherein the predetermined display characteristics include a predetermined chromaticity characteristic associated with the rendered image.

3. The method of claim 2, wherein the predetermined chromaticity characteristic is indicative of a tonal range associated with the rendered image.

4. The method of claim 1, wherein the predetermined display characteristics are associated with an object represented by the rendered image.

5. The method of claim 4, wherein the object is of an object type that satisfies a criterion.

6. The method of claim 4, wherein modifying the one or more of the plurality of luminance values includes applying a uniform luminance function to the one or more of the plurality of luminance values.

7. The method of claim 4, wherein modifying the one or more of the plurality of luminance values includes applying a luminance flattening function to the one or more of the plurality of luminance values.

8. The method of claim 1, wherein the predetermined display characteristics are associated with a scene background represented within the rendered image, and wherein modifying the one or more of the plurality of luminance values includes applying a luminance smoothing function to the one or more of the respective portions of the plurality of luminance values.

9. The method of claim 1, wherein modifying the one or more of the plurality of luminance values is a function of one or more display characteristics associated with the see-through display.

10. The method of claim 9, wherein the one or more display characteristics include a gamut range associated with the see-through display.

11. A system comprising:

a graphics processing unit (GPU) to generate a rendered image that has predetermined display characteristics, wherein the rendered image includes a plurality of portions;

a sensor subsystem to sense a plurality of luminance values associated with ambient light from a physical environment, wherein the plurality of luminance values quantifies the ambient light;

a luminance value identifier to associate each of the plurality of luminance values with a corresponding portion of the plurality of portions of the rendered image;

a luminance value modifier to modify one or more of the plurality of luminance values based on a function of the association and the predetermined display characteristics, in order to generate one or more modified portions of the plurality of luminance values;

a combiner to modify the corresponding portions of the rendered image in order to generate display data, based on the one or more modified portions of the plurality of luminance values; and a see-through display to display the display data.

12. The system of claim 11, wherein the predetermined display characteristics include a predetermined chromaticity characteristic associated with the rendered image.

13. The system of claim 12, wherein the predetermined chromaticity characteristic is indicative of a tonal range associated with the rendered image.

14. The system of claim 11, wherein the predetermined display characteristics are associated with an object represented by the rendered image.

15. The system of claim 14, wherein the object is of an object type that satisfies a criterion.

16. The system of claim 14, wherein modifying the one or more of the plurality of luminance values includes applying a uniform luminance function to the one or more of the plurality of luminance values.

17. The system of claim 14, wherein modifying the one or more of the plurality of luminance values includes applying a luminance flattening function to the one or more of the plurality of luminance values.

18. The system of claim 11, wherein the predetermined display characteristics are associated with a scene background represented within the rendered image, and wherein modifying the one or more of the plurality of luminance values includes applying a luminance smoothing function to the one or more of the plurality of luminance values.

19. The system of claim 11, wherein modifying the one or more of the plurality of luminance values is a function of one or more display characteristics associated with the see-through display.

20. A non-transitory computer readable storage medium storing one or more programs, the one or more programs comprising instructions, which, when executed by an electronic device with one or processors and a see-through display, cause the electronic device to:

obtain a rendered image that has predetermined display characteristics, wherein the rendered image includes a plurality of portions;

sense a plurality of luminance values associated with ambient light from a physical environment, wherein the plurality of luminance values quantifies the ambient light arriving at the see-through display;

associate each of the plurality of luminance values with a corresponding portion of the plurality of portions of the rendered image;

modify one or more of the plurality of luminance values based on a function of the association and the predetermined display characteristics, in order to generate one or more modified portions of the plurality of luminance values;

modify the corresponding portions of the rendered image in order to generate display data, based on the one or more modified portions of the plurality of luminance values; and display, on the see-through display, the display data.

* * * * *